United States Patent [19]

Young et al.

[11] 4,415,374

[45] Nov. 15, 1983

[54] FINE GRAINED METAL COMPOSITION

[75] Inventors: Kenneth P. Young, Ballwin; Curtis P. Kyonka, Maryland Heights; James A. Courtois, Florissant, all of Mo.

[73] Assignee: International Telephone and Telegraph Corporation, New York, N.Y.

[21] Appl. No.: 363,622

[22] Filed: Mar. 30, 1982

[51] Int. Cl.[3] ..... C22F 1/04; C22F 1/08

[52] U.S. Cl. ..... 148/2; 148/11.5 A; 148/11.5 C; 148/437; 148/432

[58] Field of Search ..... 148/11.5 A, 11.5 C, 148/11.5 R, 32, 32.5, 2; 75/10, 65, 134, 135, 146, 147

[56] References Cited

U.S. PATENT DOCUMENTS

| | | | |
|---|---|---|---|
| 2,861,302 | 11/1958 | Mann et al. | 164/504 |
| 2,963,758 | 12/1960 | Pestel et al. | 164/5 |
| 3,268,963 | 8/1966 | Mann | 164/493 |
| 3,902,544 | 9/1975 | Flemings et al. | 164/71 |
| 3,936,298 | 2/1976 | Mehrabian et al. | 75/134 R |
| 3,948,650 | 4/1976 | Flemings et al. | 75/135 |
| 3,954,455 | 5/1976 | Flemings et al. | 75/134 |
| 3,995,678 | 12/1976 | Zavaras et al. | 164/49 |
| 4,030,534 | 6/1977 | Ito et al. | 164/147 |
| 4,040,467 | 8/1977 | Alberny et al. | 164/49 |
| 4,042,007 | 8/1977 | Zavaras et al. | 164/49 |
| 4,042,008 | 8/1977 | Alberny et al. | 164/147 |
| 4,150,712 | 4/1979 | Dussart | 164/147 |
| 4,229,210 | 10/1980 | Winter et al. | 75/10 R |

FOREIGN PATENT DOCUMENTS

| | | |
|---|---|---|
| 2707774 | 9/1977 | Fed. Rep. of Germany . |
| 1525036 | 9/1978 | United Kingdom . |
| 1525545 | 9/1978 | United Kingdom . |

OTHER PUBLICATIONS

Flemings et al., "Rheocasting Processes", *AFS International Cast Metals Journal,* Sep. 1976, pp. 11–22.

Fascetta et al., "Die Casting Partially Solidified High Copper Content Alloys", *AFS Cast Metals Research Journal,* Dec. 1973, pp. 161–171.

Szekely et al., "Electromagnetically Driven Flows in Metals Processing", *Journal of Metals,* Sep. 1976, pp. 6–11.

*Primary Examiner*—L. Dewayne Rutledge
*Assistant Examiner*—R. McDowell
*Attorney, Agent, or Firm*—James B. Raden; Harold J. Holt

[57] ABSTRACT

A fine grained metal composition suitable for forming in a partially solid, partially liquid condition. The composition is prepared by producing a solid metal composition having an essentially directional grain structure and heating the directional grain composition to a temperature above the solidus and below the liquidus to produce a partially solid, partially liquid mixture containing at least 0.05 volume fraction liquid. The composition, prior to heating, has a strain level introduced such that upon heating, the mixture comprises uniform discrete spheroidal particles contained within a lower melting matrix. The heated alloy is then solidified while in a partially solid, partially liquid condition, the solidified composition having a uniform, fine grained microstructure.

24 Claims, 8 Drawing Figures

FINE GRAINED METAL COMPOSITION

This invention relates to a process for preparing a fine grained metal composition and to the composition so produced.

The advantages of shaping metal while in a partially solid, partially liquid condition have now become well known. U.S. Pat. Nos. 3,948,650 and 3,954,455 disclose a process for making possible such shaping processes by the prior vigorous agitation of a metal or metal alloy while it is in a semi-solid condition. This converts the normally dendritic microstructure of the alloy into a non-dendritic form comprising discrete degenerate dendrites in a lower melting matrix. The resulting alloy is capable of being shaped in a semi-solid condition by casting, forging or other known forming processes.

Considerable cost advantage results from practice of the foregoing semi-solid technology. However, it is subject to certain limitations. The first part of the process normally involves the production of cast bars having the required non-dendritic structure. The technical feasibility of casting diameters of less than about one inch on a practical scale is very low and, because of the nature of the process even were it feasible, would result in extremely low output. Moreover, the casting process in many instances produces cast bars which exhibit less than desirable skin microstructure which must be trimmed mechanically or otherwise treated for subsequent processing. In addition, the generation of diameters of varying size is cumbersome and expensive since each diameter necessitates a complete casting cycle including set-up, mold preparation and running. Flexibility is, therefore, low.

It is accordingly a primary object of the present invention to provide a more flexible and economical process for producing a fine grained metal composition suitable for forming in a partially solid, partially liquid condition.

It is an additional object of the invention to provide such a process which does not require the vigorous agitation of the metal composition during its preparation.

It is still an additional object of the invention to provide a metal composition having a uniform, fine grained microstructure which is unobtainable from any prior metal forming processes.

The foregoing and other objects of the invention are achieved by a process involving the preparation of a metal composition suitable for forming in a partially solid, partially liquid condition, the process comprising producing a solid metal composition having an essentially directional grain structure, heating said directional grain composition to a temperature above the solidus and below the liquidus to produce a partially solid, partially liquid mixture containing at least 0.05 volume fraction liquid, said composition prior to heating, having a strain level introduced such that upon heating the mixture comprises uniform discrete spheroidal particles contained within a matrix composition having a lower melting point than said particles, solidifying said heated compositions, said solidified composition having a uniform, fine grained microstructure comprising uniform discrete spheroidal particles contained within a lower melting matrix. The invention also encompasses metal compositions produced by the foregoing process which have a more uniform and finer grain structure than are obtainable by any other known process.

The invention will be better understood by reference to the accompanying drawing in which.

Figure 1:
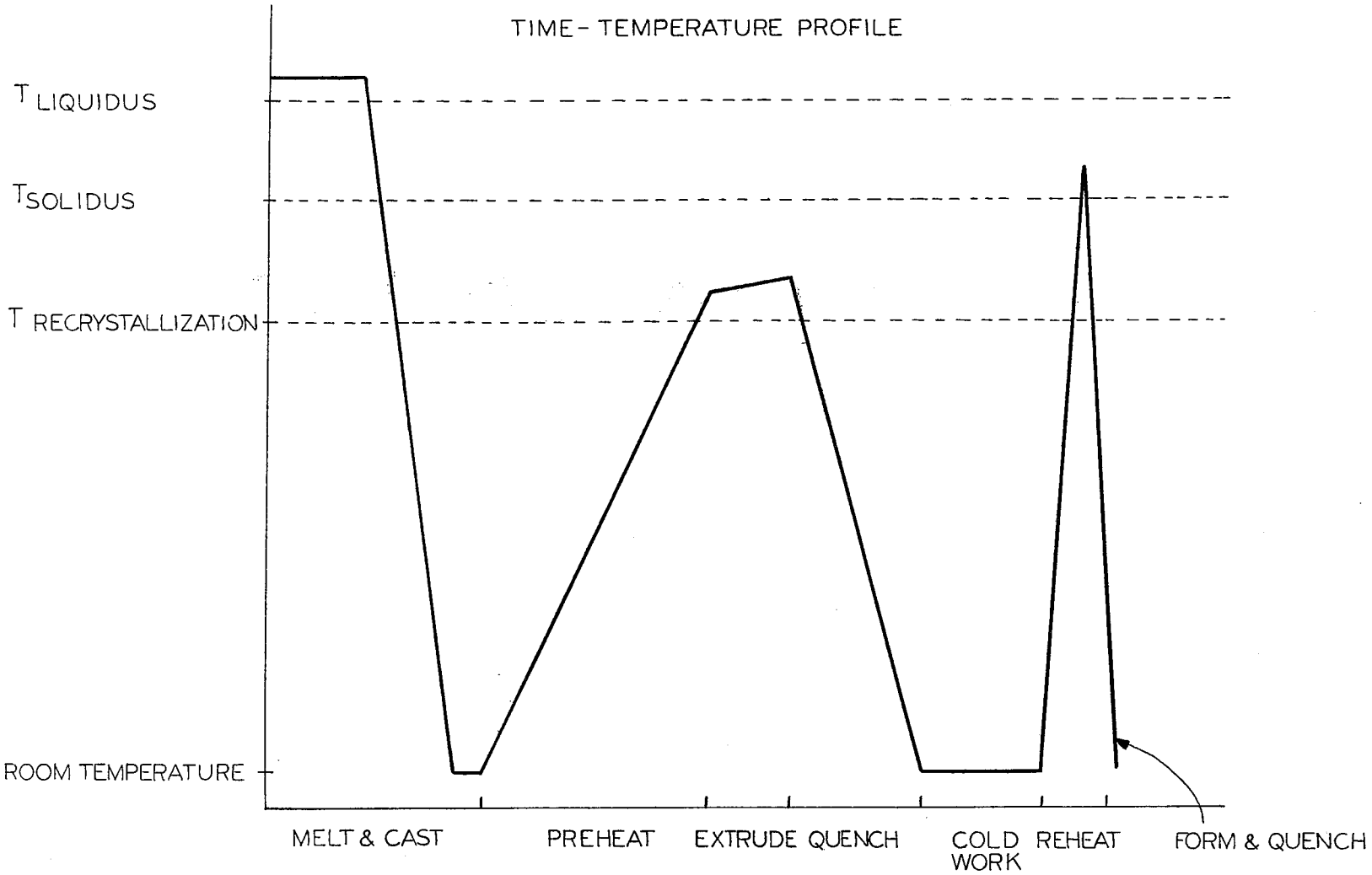
FIG. 1 is a time-temperature profile of a typical process in accordance with the practice of the invention.

It is normally considered extremely harmful to heat an alloy even a small amount above its solidus temperature during heat treating or shaping processes (other than casting) because of grain boundry melting and resulting embrittlement of the metal. Such melting, often referred to as hot shortness or burning, adversely affects workability and decreases the strength and ductility of the alloy. There are isolated disclosures in the literature of exceptions to the avoidance of melting but they are largely variations of solutionizing processes in which heterogeneities are removed by dissolving them in a matrix phase. For example, U.S. Pat. No. 2,249,349 heats an aluminum alloy to incipient fusion to improve its hot workability. U.S. Pat. Nos. 3,988,180, 4,106,956, 4,019,927 heat an alloy to just above the solidus temperature and hold the alloy at that temperature until the dendritic phase becomes globular. In all of this prior art, however, the heterogeneities caused by melting are deleterious and must be removed prior to subsequent working. The present invention involves a technique for inducing heterogeneities into the structure in such a fashion that the structures can be transformed into a homogeneous mixture of very uniform discrete particles. The product of the present process is a metal composition having a uniform, fine grained microstructure consisting of spheroidal particles engulfed in a solidified liquid phase. In the case of aluminum alloys, these particles are less than 30$\mu$ in diameter.

The process of the invention has a number of very significant advantages. Casting of the starting billet may be carried out in a single convenient diameter, e.g. 6", at one location and reduced to any desirable smaller diameter at the same or a second location using conventional extrusion equipment and technology. The process permits removal of any dendritic exterior skin on the staring billet as part of normal practice prior to extrusion so that the extruded billet exhibits no skin effect. Moreover, the process produces a considerable refinement of the microstructure of the final product, including its size, shape and distribution relative to the starting billet microstructure.

In the practice of the present process, a directional grain structure is produced by hot working a metal composition, as by extrusion, rolling, forging, swaging or other means, at a temperature below the solidus temperature. By hot working is meant any process which deforms a metal or alloy between the recrystallization temperature (typically, 0.7 $T_{solidus}$ Kelvin) and the solidus temperature ($T_{solidus}$), such that it produces a striated or directional grain structure. According to a preferred embodiment of the invention, the directional grain structure is produced by extrusion. The extrusion ratio should normally be greater than 10/1 to produce the desired directional grain structure and may range as high as economically practical. We have found useful extrusion ratios frequently range from about 19/1 to about 60/1.

A critical level of strain must be introduced into the metal or alloy either concurrently with and as an integral part of the hot working step, or as a separate step subsequent to hot working and prior to heating to above the solidus temperature. Strain is introduced integral with the hot working operation, for example, by an in-line straightening operation, by rapid chilling of the hot worked material to introduce thermal strains or by extruding at lower temperatures such as to leave residual strains in the extruded product. Lower extrusion or other hot working temperatures tend to leave higher residual strains in the extrusion since the extrusion pressures go up as the temperatures go down, i.e. more energy is used by the extrusion process. As a separate step, strain is introduced by cold working. Cold working operations found to be effective include drawing, swaging, rolling and compression or upsetting. Strain level is meant to represent any residual strain remaining within a grain after the deformation process is completed. The actual strain level will vary with the specific metal or alloy and with the type and conditions of hot working. In the case of extruded aluminum alloy, the strain level should be equivalent to at least a 12% cold worked alloy. In general, the level of strain can be determined empirically by determining whether, after heating to above the solidus temperature, the partially solid, partially liquid mixture comprises uniform discrete spheroidal solid particles contained within a lower melting matrix composition. Alloys, in which the directional grain structure is produced by extrusion, and which are separately cold worked, have been found to possess a particularly improved uniform, fine grained microstructure unavailable by other processes.

Upon completion of hot working and any required cold working, the alloy is then reheated to a temperature above the solidus and below the liquidus. The specific temperature is generally such as to produce a 0.05 to 0.8 volume fraction liquid, preferably at least 0.10 volume fraction liquid and in most cases a 0.15 to 0.5 volume fraction liquid. The reheated alloy may then be solidified and again reheated for shaping in a partially solid, partially liquid condition or the shaping step may be integral with the original reheat of the alloy to a partially solid, partially liquid state. The second reheat of the alloy may be to a higher fraction solid than the first reheat, but it is preferable not more than 0.20 fraction solid greater.

In the preferred practice of the invention, the alloy is heated to a semi-solid state and shaped at the same time in a press forging operation. In such a process, the alloy charge is heated to the requisite partially solid, partially liquid temperature, placed in a die cavity and shaped under pressure. Both shaping and solidification times are extremely short and pressures are comparatively low. This press forging process is more completely disclosed in copending application Ser. No. 290,217, filed Aug. 5, 1981, the disclosure of which is hereby incorporated by reference. Other semi-solid forming processes which may be used are die casting, semi-solid extrusion and related shaping techniques.

FIG. 1 is a typical time-temperature profile of a process in accordance with the invention. The vertical axis is temperature; the horizontal axis is time. The graph is intended to graphically portray a relative time-temperature relationship rather than set forth precise values. As can be seen from the graph, a metal is melted and solidified to form a cast billet, either dendritic or non-dendritic. The cast billet is preheated, e.g. approximately 30 minutes for a typical aluminum casting alloy, to above the recrystallization temperature, extruded and quenched to produce a solid metal composition having a directional grain structure. The extruded metal composition is then cold worked at room temperature to introduce a proper level of strain. It is then reheated above the solidus temperature, e.g. about 100 seconds for a typical aluminum alloy, to a semi-solid condition and rapidly quenched.

The starting material for practice of the present process may be a dendritic metal or alloy of the type conventionally cast into billets or a non-dendritic metal or alloy of the type in which a billet has been vigorously agitated during freezing in accordance with the teachings of the aforementioned U.S. Pat. No. 3,948,650. Such agitation produces a so-called slurry cast structure, that is one having discrete, degenerate dendritic particles within a lower melting matrix. Copending application Ser. No. 363,621 (D. U. Gullotti et al. 1-4-3-), filed of even date herewith, is directed to a process in which the starting material is a billet having a slurry cast structure in which the slurry cast structure is rehabilitated by heating to a semi-solid state. The disclosure of said copending application is hereby incorporated by reference. Billets which have been produced under conditions of vigorous agitation may be produced by the continuous direct chill casting process set forth in copending application Ser. No. 015,250, filed Feb. 26, 1979, the disclosure of which is also hereby incorporated by reference. In that application, molten metal is cooled while it is vigorously agitated in a rotating magnetic field. The process is continuous and produces continuous lengths of billets having a discrete degenerate dendritic structure. Billets are referred to below as billets which have been chill cast under a shearing environment during solidification to distinguish those which have been vigorously agitated from those which have not.

The microstructure of non-dendritic composition produced in accordance with the aforementioned U.S. Pat. No. 3,948,650 and which is also produced in accordance with the process of the present invention may be variously described as comprising discrete spheroidal particles contained within a matrix composition having a lower melting point or, alternatively, as discrete primary phase particles enveloped by a solute-rich matrix. Such a structure will hereinafter be described in accordance with the first-mentioned description, but it should be understood that the various descriptions are essentially alternative ways of describing the same microstructure.

The following examples are illustrative of the practice of the invention. Unless otherwise indicated, all parts and percentages are by weight except for fraction solids which are by volume.

EXAMPLE 1

Figure 2:
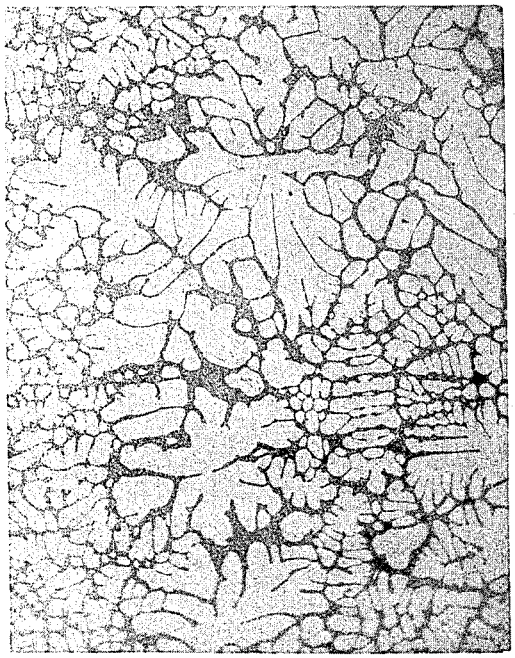
FIGS. 2 through 8 are photomicrographs showing the microstructure of alloys at various stages in the process of the invention. All micrographs are at a magnification of 100.

An aluminum casting alloy (Aluminum Association Alloy 357) was direct chill cast without shearing to a 6" diameter. FIG. 2 is a micrograph of a crosssection of the direct chill cast bar in which its dendritic structure is apparent. The alloy had the following percent composition:

| | | | |
|---|---|---|---|
| Si | 7.0 | Zn | .02 |
| Cu | .010 | Ti | .10 |
| Mn | .004 | Al | Rem. |

-continued

| | |
|---|---|
| Mg | 0.50 |

Figure 3:
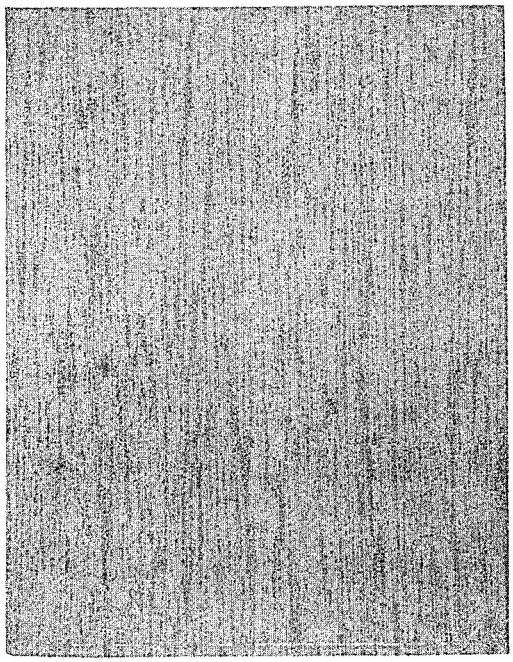
Figure 4:
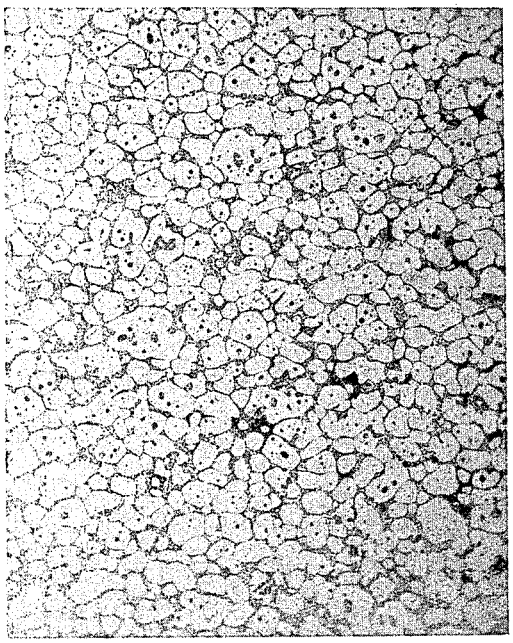

A section of the cast bar was preheated to 380° C. in less than ½ hour and extruded at a 50/1 ratio into a 0.875" diameter rod. Extrusion pressure was 67,000 psi. The rod exited at 25'/minute and at 460° C. and was fan quenched. The extruded bar was stretched straight (approximately 1% permanent set) to introduce strain into the bar as an integral step of the extrusion process. FIG. 3 is a photomicrograph of a longitudinal section of the extruded stretched bar. Its directional grain structure is very evident. The extruded samples were then inductively reheated in a 3,000 Hz field at 6.75 kW in a 2" ID coil by 6" long for 100±5 seconds to a 0.7–0.9 fraction solid and immediately water quenched to 24° C. These quenched samples were metallographically examined for particle size and shape. FIG. 4 is a micrograph of a crosssection of the reheated and quenched sample. FIG. 4 demonstrates the dramatic refinement of the microstructure obtained over that of the starting billet (FIG. 2). It further demonstrates that the severely worked microstructure of the extruded section can be converted to a slurry microstructure by heating to a 0.1 or higher fraction liquid.

EXAMPLE 2

Figure 5:
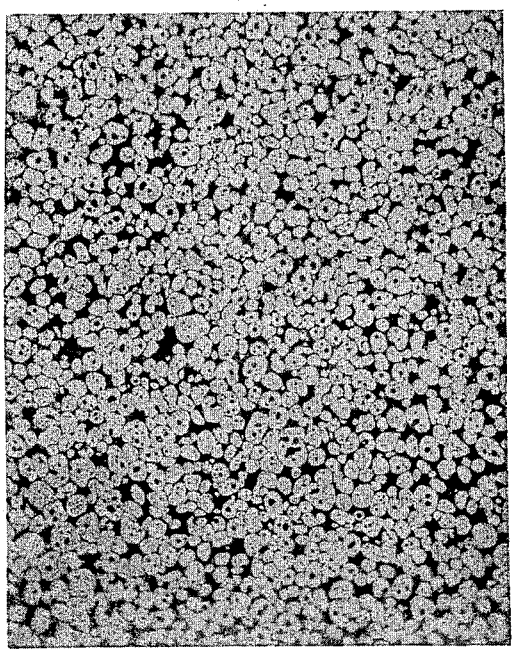

An aluminum casting alloy (Aluminum Association Alloy 357) was cast as in Example 1, preheated to 380° C. within ½ hour and extruded into 1.250" diameter rod. The extrusion pressure was 14,000 psi. The rod exited at 14'/minute and 500° C. and was fan quenched. The extruded bar was stretched straight approximately 1% permanent set. Portions of the rod were then drawn 36% to 1" diameter. Samples were taken of the as-extruded and drawn material and inductively reheated and press forged as in Example 1 but this time into a 0.050" wall cup. FIG. 5 is a representative micrograph of a section through the final product again showing a uniform, fine grained "slurry-type" microstructure.

EXAMPLE 3

An aluminum wrought alloy (Aluminum Association Alloy 2024) was direct chill cast, homogenized (to reduce extrusion pressure and tendency to hot tear during hot working) and extruded to a 1" diameter. The alloy had the following composition:

| | |
|---|---|
| Cu | 4.4 |
| Mn | .6 |
| Mg | 1.5 |
| Al | Rem. |

Figure 6:
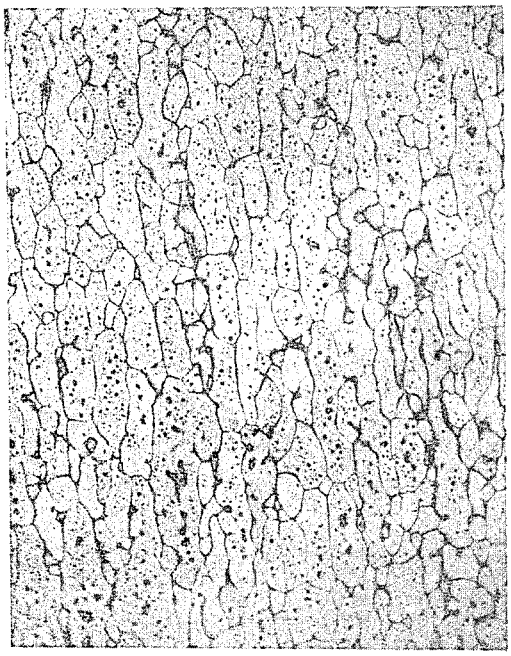
Figure 7:
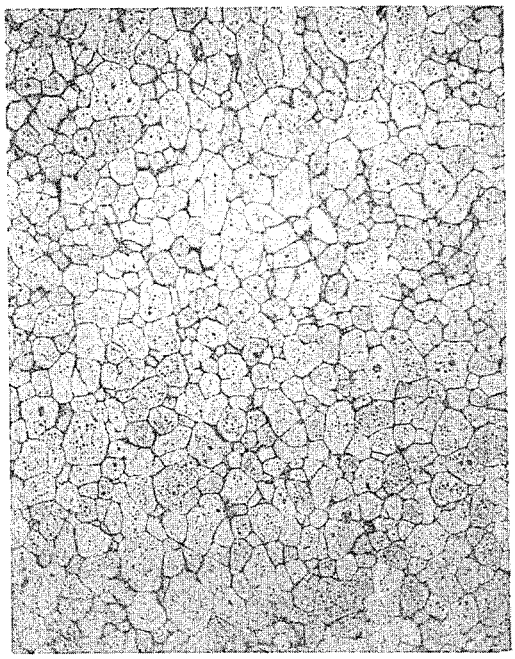

Samples of the as-extruded bars were reheated as in Example 1 while other samples of the extruded bars were compressed 29% and reheated. FIG. 6 is a representative micrograph of the final reheated but not cold worked samples. FIG. 7 is a representative micrograph of the cold worked samples. It is apparent that the cold worked samples had a considerably more refined microstructure than the sample which had been reheated without cold work.

EXAMPLE 4

Example 3 was repeated with an aluminum wrought alloy (Aluminum Association Alloy 6061) having the following composition:

| | |
|---|---|
| Si | .6 |
| Cu | .28 |
| Mg | 1.0 |
| Cr | .2 |
| Al | Rem. |

Again micrographs were made of samples which were extruded and reheated and samples which were extruded, compressed 29% and reheated. Microstructure differences were as set forth in Example 3 and as illustrated by FIGS. 6 and 7.

EXAMPLE 5

Example 3 was again repeated with an aluminum wrought alloy (Aluminum Association Alloy 6262) having the following composition:

| | | | |
|---|---|---|---|
| Si | .6 | Zn | 2.0 |
| Cu | .28 | P6 | .6 |
| Mg | 1.0 | Bi | .6 |
| Cr | .09 | Al | Rem. |

Comparative results were as set forth in Examples 3 and 4.

EXAMPLE 6

Example 5 was again repeated with an aluminum wrought alloy (Aluminum Association Alloy 7075) having the following composition:

| | | | |
|---|---|---|---|
| Cu | 1.6 | Zn | 5.6 |
| Mg | 2.5 | Al | Rem. |
| Cr | .23 | | |

Results were as set forth in Examples 3–5.

EXAMPLE 7

An aluminum alloy (Aluminum Association Alloy 357) was direct chill cast under a shearing environment to a 6" diameter. The alloy had the following percent composition:

| | | | |
|---|---|---|---|
| Si | 7.0 | Zn | .02 |
| Cu | .010 | Ti | .10 |
| Mn | .004 | Al | Rem. |
| Mg | .30 | | |

A 22" length was preheated to 520° C. in less than ½ hour and extruded into a 0.875" diameter rod. Extrusion pressure was 10,000 psi. The rod exited at 24'/minute and at 520° C. and was fan quenched. 1" sections were then axially compressed at room temperature between two parallel plates so that the length was reduced 5, 10, and 16%. Samples then were taken of the as-extruded and the compressed sections and inductively reheated in a 3,000 Hz field at 6.75 kW in a 2" ID coil by 6" long for 100±5 seconds to a 0.7–0.9 fraction solid and immediately water quenched to 24° C. These quenched samples were metallographically examined for particle size and shape.

A 35 gram 1" section of the extruded billet was then axially compressed 25% and press forged into a threaded plug in accordance with the process of the aforementioned copending application Ser. No. 290,217 in a partially solid, partially liquid condition. Reheat time was 50 seconds, fraction solid was 0.85, dwell time was 0.5 seconds and pressure was 15,000 psig.

Photomicrographs at various stages of the process were taken. The starting 6" diameter billet exhibited particles of approximately 100 microns diameter. The extruded billet showed a directional grain microstructure in which the grains were very elongated. Micrographs of the center section of reheated billets, which were as-extruded and compressed 5, 10 and 16% respectively, showed that particle size and shape continued to improve as the strain was increased, particularly as strain was increased over 10%. The microstructure of a sample which was compressed 25% and press forged into a threaded plug showed much finer scale microstructure and more uniform shape and distribution of the grains in the final product as compared with the starting billet. It also showed the remarkable influence of the residual strain upon the reheated grain structure of the extruded product.

EXAMPLE 8

The aluminum casting alloy of Example 7 was direct chill cast as in that example to a 6" diameter billet. A 22" section was preheated within ½ hour to 330° C. (much lower than Example 1) and extruded into a 1.125" diameter rod. Extrusion pressures for this rod were 46,000 psi (much greater than Example 1). The rod exited at 23 fpm 490° C. and was fan quenched. Samples were inductively reheated to a 0.7–0.9 fraction solid as in Example 7 and water quenched. These quenches were metallographically examined for particle size and shape and found to be similar to the reheated, compressed 25% and press forged sample of Example 7. In this extrusion, the combination of low preheat T° (330° C.) and fan cooling produced suitable residual strain in the extrusion.

EXAMPLE 9

Figure 8:
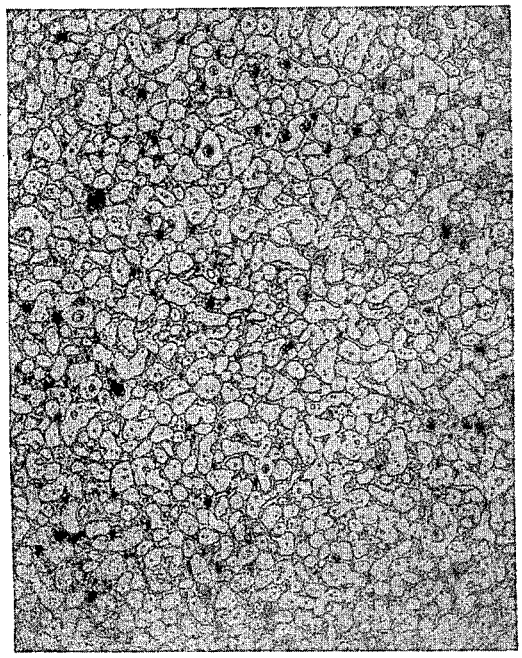

A copper wrought alloy C544 of 4%Zn, 4%Sn, 4%Pb, balance copper, was extruded to produce a directional grain structure and cold reduced 35% to a 1" diameter. Samples of the as-extruded bars were reheated using the procedure of Example 1 but for longer times, typically 200 seconds, in order to produce the partially solid, partially liquid structure and press forged into cams for use in water pumps. FIG. 8 is a micrograph of a crosssection of the press forged final product.

EXAMPLE 10

Copper wrought alloy C360 containing 3.0% manganese, 35.5 zinc, balance copper, was extruded and then cold reduced approximately 18% to a 1" diameter. Samples of the cold worked extrusion were reheated as in Example 1. Micrographs of crosssections of the final reheated alloy showed a microstructure very similar to that of FIG. 8.

While the foregoing examples have demonstrated practice of the process with a variety of aluminum and copper alloys, the process is applicable to other metals and metal alloys as long as the metal is capable of forming a two-phase system having solid particles in a lower melting matrix phase. The process has for example been successfully carried out on copper wrought alloy C110 consisting of 0.04% oxygen, balance copper. Representative additional alloys which may be used are those of iron, nickel, cobalt, lead, zinc and magnesium. The alloys may be so-called casting alloys such as aluminum alloys 356 and 357 or wrought alloys such as aluminum alloys 6061, 2024 and 7075 and copper alloys C544 and C360.

We claim:

1. A process for the preparation of a metal composition suitable for forming in a partially solid, partially liquid condition, said process comprising producing a solid metal composition having an essentially directional grain structure, heating said directional grain composition to a temperature above the solidus and below the liquidus to produce a partially solid, partially liquid mixture containing at least 0.05 volume fraction liquid, said composition prior to heating having a strain level introduced such that upon heating, the mixture comprises uniform discrete spheroidal particles contained within a matrix composition having a lower melting point than said particles, solidifying said heated composition, said solidified composition having a uniform, fine grained microstructure comprising uniform discrete spheroidal particles contained within a lower melting matrix.

2. The process of claim 1 in which the directional grain structure is produced by hot working.

3. The process of claim 2 in which said hot working step is performed by extruding said composition.

4. The process of claim 1 in which the composition is cold worked subsequent to production of the directional grain structure to introduce said strain.

5. The process of claim 2 in which the strain is introduced during hot working.

6. The process of claim 4 in which the cold working is effected by upsetting.

7. The process of claim 4 in which the cold working is effected by swaging.

8. The process of claim 4 in which the cold working is effected by drawing.

9. The process of claim 4 in which the cold working is effected by rolling.

10. The process of claim 1 in which said composition, prior to producing said directional grain structure, contains a dendritic structure.

11. The process of claim 1 including the further step of shaping said composition while it is in a partially solid, partially liquid condition.

12. The process of claim 11 in which said composition is shaped before said heated composition is solidified.

13. The process of claim 12 in which said composition is shaped by press forging.

14. The process of claim 1 in which the composition is a casting alloy.

15. The process of claim 1 in which the composition is a wrought alloy.

16. The process of claim 1 in which the composition is an aluminum alloy.

17. The process of claim 1 in which the composition is a copper alloy.

18. The process of claim 1 in which said directional grain composition is heated to a temperature at which the partially solid, partially liquid mixture contains up to 0.8 volume fraction liquid.

19. The process of claim 18 in which the composition is heated to a minimum volume fraction liquid of 0.10.

20. The process of claim 19 in which the composition is heated to a 0.15 to 0.5 volume fraction liquid.

21. A process for the preparation of a metal alloy suitable for forming in a partially solid, partially liquid condition, said process comprising hot extruding an alloy at a temperature below the solidus temperature to produce an essentially directional grain structure, cold working said extruded alloy to introduce strain therein, reheating said cold worked alloy to a temperature above the solidus and below the liquidus to produce a partially solid, partially liquid mixture containing from 0.05 to 0.8 volume fraction liquid, said alloy, prior to reheating, having a strain level such that upon reheating, the mixture comprises uniform discrete spheroidal particles contained within a matrix composition having a lower melting point than said particles, solidifying said reheated alloy to produce a solidified alloy having a uniform, fine grained microstructure comprising discrete spheroidal particles contained within a lower melting matrix.

22. The process of claim 21 in which said reheated alloy is shaped while in a partially solid, partially liquid condition.

23. The process of claim 21 in which said alloy is hot extruded at a hot extrusion ratio greater than 10 to 1.

24. An aluminum alloy having a uniform, fine grained microstructure comprising uniform discrete spheroidal particles contained within a lower melting matrix produced in accordance with the process of claim 21.

* * * * *